US008454201B2

(12) United States Patent
Cohen

(10) Patent No.: US 8,454,201 B2
(45) Date of Patent: Jun. 4, 2013

(54) SOLAR POWERED ILLUMINATOR FOR PLANTS AND DECORATIVE ARTICLES

(75) Inventor: Richard Cohen, Ann Arbor, MI (US)

(73) Assignee: RSR Industries, Inc., Ann Arbor, MI (US)

( * ) Notice: Subject to any disclaimer, the term of this patent is extended or adjusted under 35 U.S.C. 154(b) by 222 days.

(21) Appl. No.: 12/877,687

(22) Filed: Sep. 8, 2010

(65) Prior Publication Data

US 2012/0057332 A1 Mar. 8, 2012

(51) Int. Cl.
*F21V 19/02* (2006.01)

(52) U.S. Cl.
USPC ..... 362/285; 362/183; 362/418

(58) Field of Classification Search
USPC ..... 362/183, 405, 418, 419, 422, 285, 362/287, 289, 429–430; 40/443, 502
See application file for complete search history.

(56) References Cited

U.S. PATENT DOCUMENTS 4,143,487 A * 3/1979 Hollwarth ..... 47/59 R
5,564,816 A * 10/1996 Arcadia et al. ..... 362/183
5,800,049 A * 9/1998 Todd, Jr. ..... 362/294
6,004,002 A * 12/1999 Giannone ..... 362/183
6,076,940 A 6/2000 Sanford, Jr.
7,021,787 B1 * 4/2006 Kuelbs ..... 362/183
7,029,144 B2 4/2006 Fu
7,033,045 B1 * 4/2006 Kinkead ..... 362/253
2003/0103357 A1 * 6/2003 Drake et al. ..... 362/403
2005/0083681 A1 * 4/2005 Yeh ..... 362/122
2010/0175318 A1 * 7/2010 Ahmadi ..... 47/66.6

* cited by examiner

*Primary Examiner* — Robert May
(74) *Attorney, Agent, or Firm* — Gifford, Krass, Sprinkle, Anderson & Citkowski, P.C.

(57) ABSTRACT

A system for illuminating a potted plant, statuary or other decorative articles comprises a base having a plurality of lighting units disposed around the periphery thereof to illuminate the article from below. The base may be circular, having a diameter in the range of 10 to 24 inches. A solar panel generates electricity from sunlight to charge a battery, and switching circuitry interconnects the battery to the lighting units when ambient light falls to a predetermined level. Each lighting unit may be integrally formed with the base, permanently or removably attached to the base, or coupled to the periphery of the base through one or more articulating joints and/or telescoping arms. The base may include a peripheral lip, thereby forming a water-holding tray to support a potted plant. The solar panel, battery and photodetector may be disposed in a remote housing and interconnected to the lights through electrical wiring.

13 Claims, 6 Drawing Sheets

SOLAR POWERED ILLUMINATOR FOR PLANTS AND DECORATIVE ARTICLES

FIELD OF THE INVENTION

This invention relates generally to gardens, architectural lighting, and so forth, and, in particular, to an illuminator for potted plants and other decorative articles which is solar powered.

BACKGROUND OF THE INVENTION

There are devices which illuminate plants contained within a planter, but these typically dispose the light sources on the rim of the container itself. One example is U.S. Pat. No. 6,076,940 entitled "Planter Light Accessory." This accessory includes a generally cylindrical housing having a side wall defining openings at upper and lower ends, supporting a generally horizontal edge portion. A light source is mounted on the edge portion for illuminating the plant. The accessory fits into an existing pot, and uses a light source in the form of a fiber optic light assembly.

There are also many lighting fixtures which use solar energy to charge a rechargeable battery to conserve on power consumption. As one example of many, U.S. Pat. No. 7,029,144 discloses a multi-purpose lighting fixture that includes a solar energy collection ring and a through hole wherein one or multiple LEDs are distributed on a circuit board and connected to a power supply powered by a rechargeable battery. However, this configuration, and others like it, are intended for a more permanent installation, and not intended for garden up-lighting.

SUMMARY OF THE INVENTION

A system for illuminating a potted plant, statuary or other decorative articles comprises a base having a plurality of lighting units disposed around the periphery thereof to illuminate the article from below. The base may be circular, having a diameter in the range of 10 to 24 inches.

A solar panel generates electricity from sunlight to charge a battery, and switching circuitry interconnects the battery to the lighting units when ambient light falls to a predetermined level as detected by a photodetector. At least a portion of the solar panel may serve as the photodetector.

Each lighting unit may be integrally formed with the base, permanently or removably attached to the base, or coupled to the periphery of the base through one or more articulating joints and/or telescoping arms. The base may include a peripheral lip, thereby forming a water-holding tray to support a potted plant. The base has an underside which may further include a plurality of casters.

The solar panel, battery and photodetector may be disposed in a remote housing and interconnected to the lights through electrical wiring. A solar panel may also be disposed on a portion of the base, or on or in one or more of the lighting units. According to one preferred embodiment the lighting units are can-shaped, each with one or more light-emitting diodes.

DETAILED DESCRIPTION OF THE PREFERRED EMBODIMENTS

Figure 1:
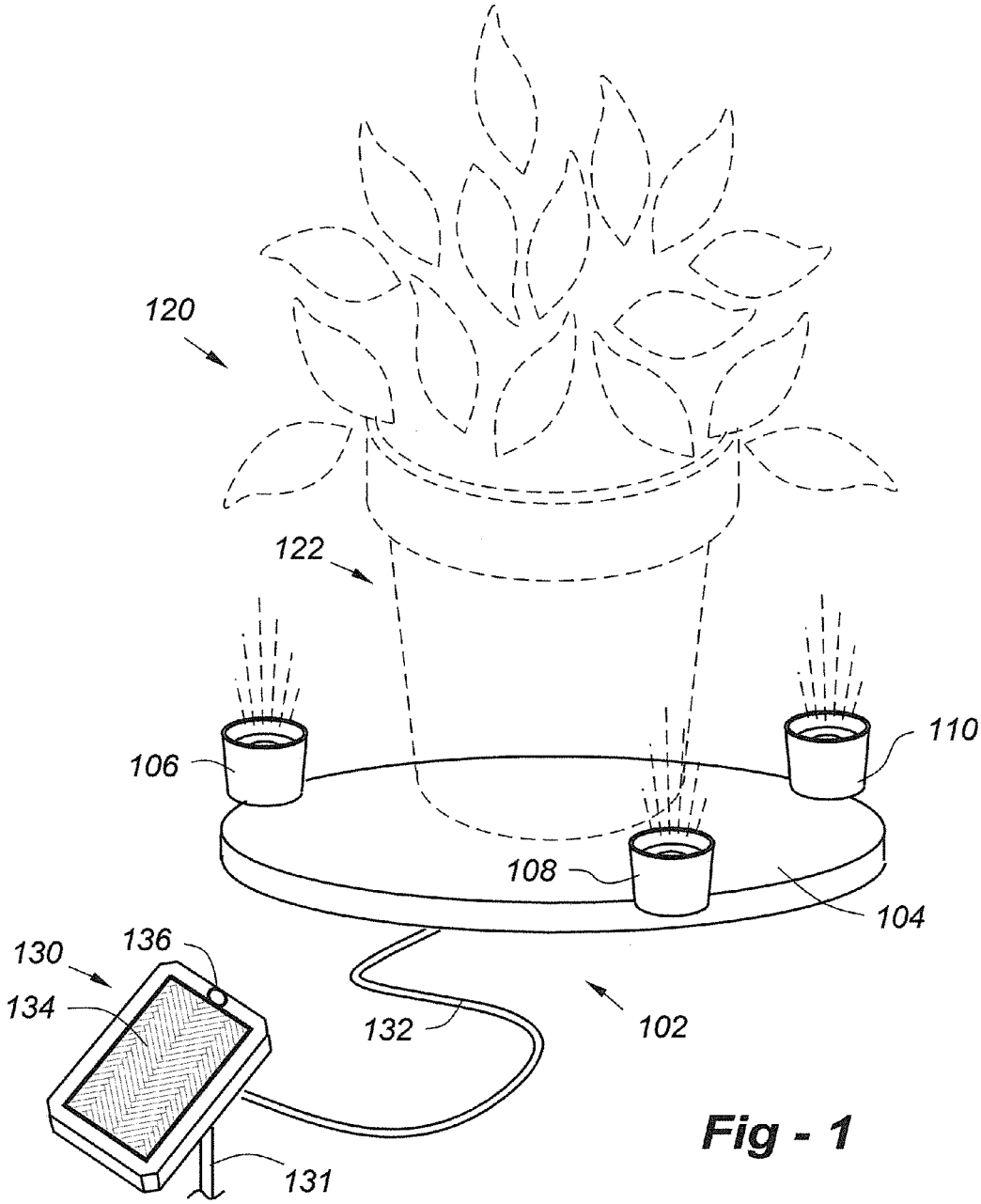
FIG. 1 is a schematic illustration of the preferred embodiment of the invention.

Turning now to the drawings, FIG. 1 illustrates a preferred embodiment of the invention generally at 102 in the form of some sort of base or platform 104 having one or more upwardly directed lights 106, 108, 110. In this case a plant 120 in a pot 122 is situated on base 104. The lights 106, 108, 110 are powered by a solar-energized battery pack 130 connecting to the lights via a cable 132. The power source 130 includes at least one solar panel 134 and an optional stake 131 allowing the unit to be placed into the ground nearby the assembly 102. In the preferred embodiment a photocell 136 is used to turn on the lights when the ambient light falls to a predetermined level. Depending upon circuit sophistication, the solar panel 134 itself may be used as a light detector, thereby foregoing the need for a separate photocell.

Figure 2:
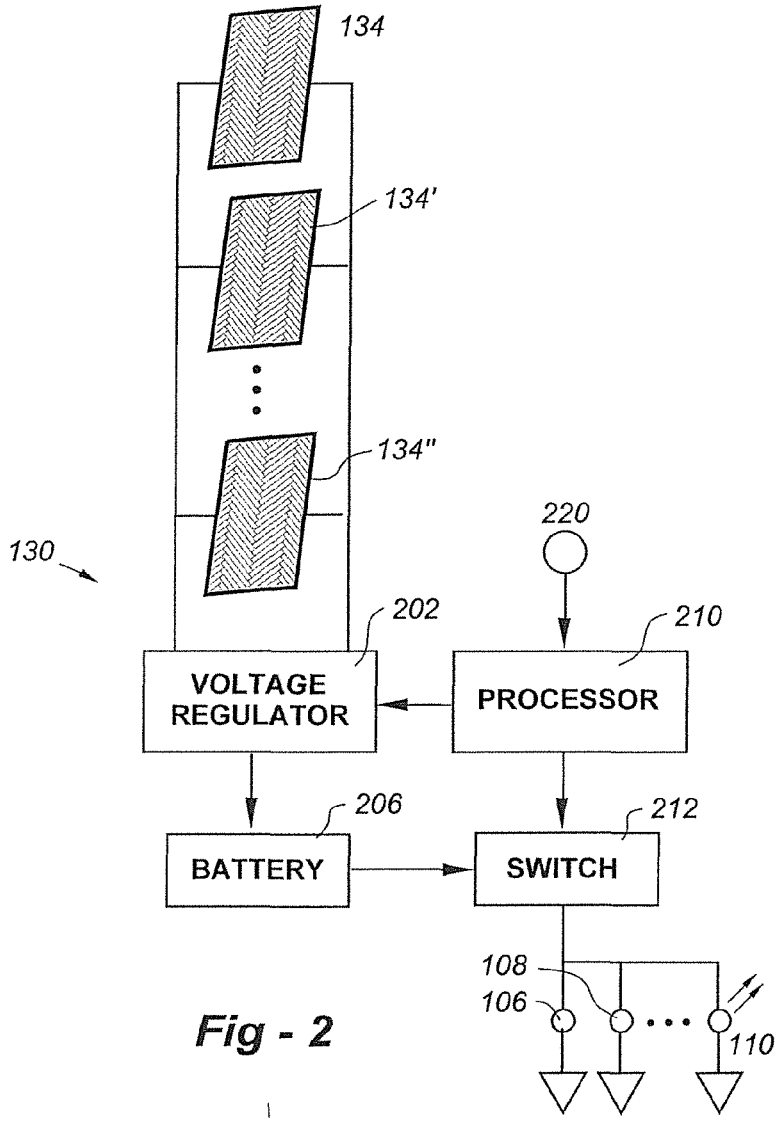
FIG. 2 is a block diagram illustrating electrical subsystems associated with the invention.
Figure 3:
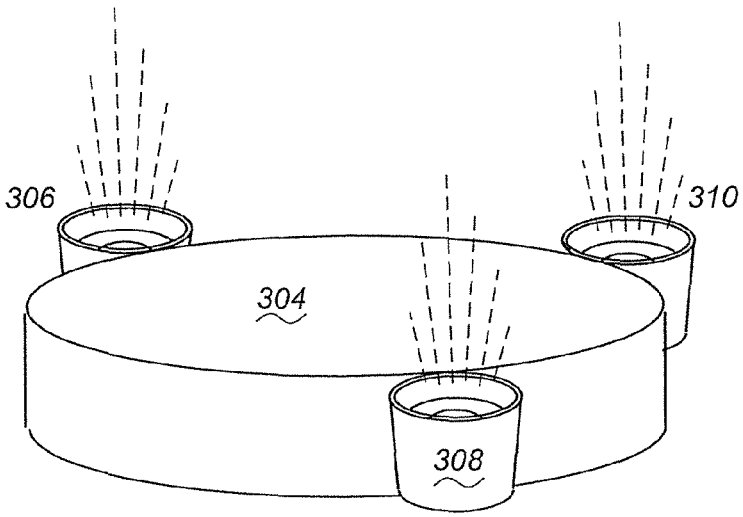
FIG. 3 illustrates an embodiment of the invention wherein lights surround a tray that can hold water for a potted plant.

FIG. 2 is a block diagram showing electrical components associated with the preferred embodiments, generally at 130. One or more solar panels 134, 134', 134" are connected to a voltage regulator 202, in series or parallel, as shown. The voltage regulator 202 may be nothing more than a single device such as a Zener diode or other discrete component. In some cases the panel or panels themselves may be used to charge battery 206. A processor 210, which may be implemented with a few discrete components, operates a switch 212 to route power from battery 206 to one or more lights 106, 108, 110 when detector 220 determines that ambient light has fallen to a predetermined level. Again, depending upon the circuit configuration, one or more of the panels 134 may be used as the light detector, thereby foregoing the need for a separate ambient light detector 220. FIG. 3 is a perspective view drawing showing lights in cans 306, 308, 310 connected to a tray 304 having side walls enabling the tray itself to hold water to receive a potted plant, for example. In this and other diagrams, the solar collector is not shown for the sake of simplicity.

Figure 4:
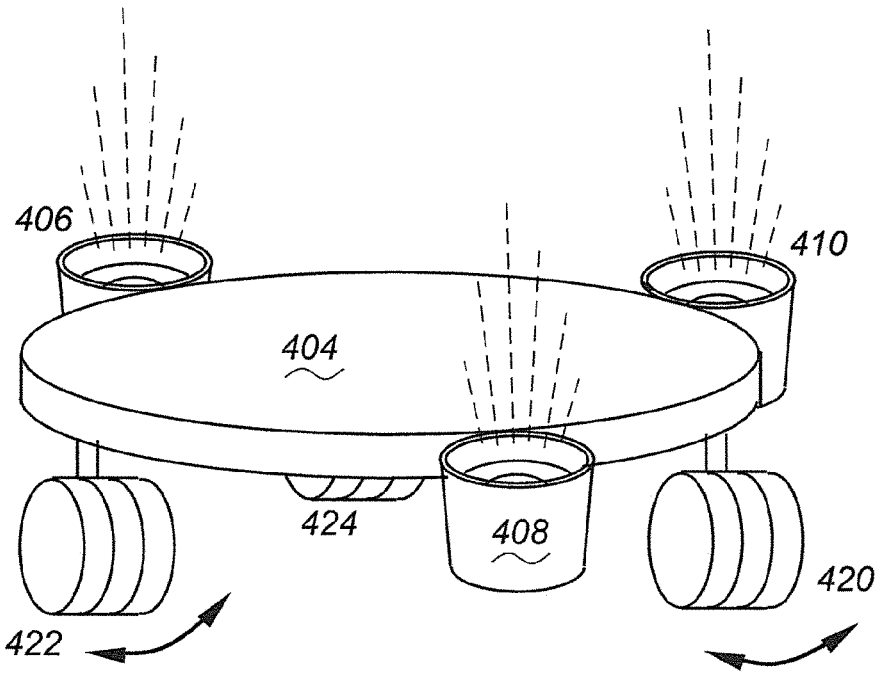
FIG. 4 shows an embodiment of the invention with casters for repositioning on a deck, for example.

FIG. 4 shows the optional use of casters 420, 422, 424 on the underside of a base 404 to which there are attached lighting cans 406, 408, 410. Such a configuration would be advantageous to move heavier plants or other decorative articles around on a cement or wooden surface, for example.

Figure 5:
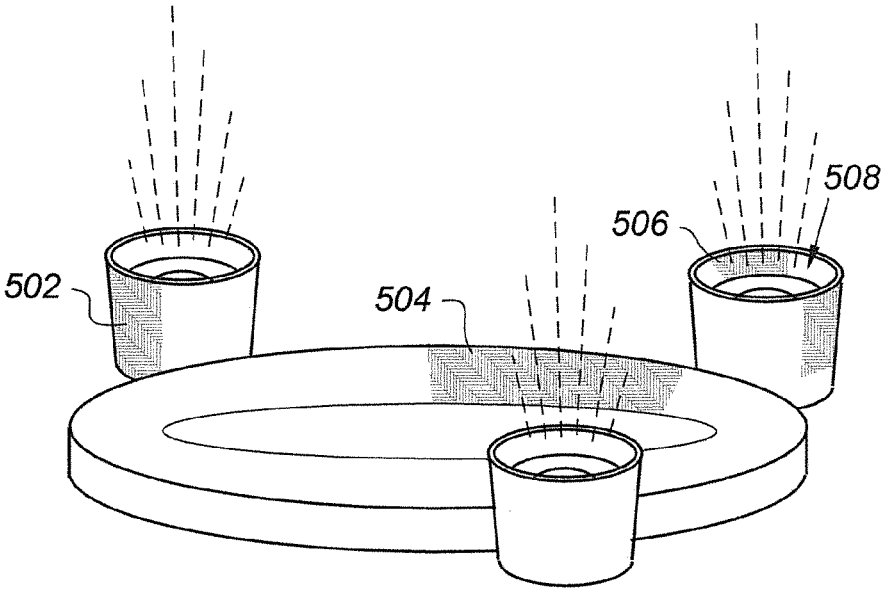
FIG. 5 illustrates how solar panels can be located in different areas of the structure.

While FIG. 1 shows a solar panel disposed on a remote power pack, the solar panel may be located on the structure itself, as shown in FIG. 5. In particular, the photovoltaic cells may be included on the side of one or more of the cans for lighting 502, or on the platform itself, preferably in a peripheral ring 504. As a further alternative, the photovoltaic cells may be located within the can at 506, surrounding one or more light sources 508, as shown.

Figure 6:
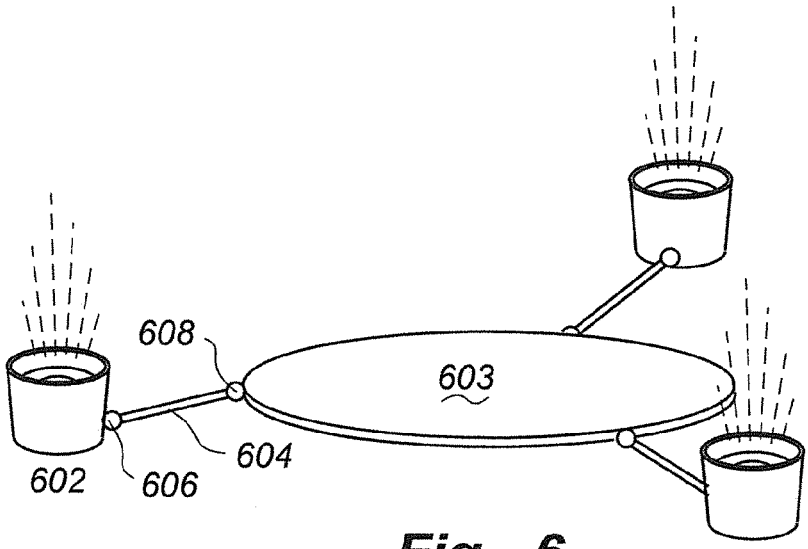
FIG. 6 is a drawing that illustrates the use of lighting units on arms with one or more swivel joints.

The lighting units may be rigidly coupled to the base or, as shown in FIG. 6, each lighting unit 602 may be coupled to the base 603 through an arm 604 having swivel joints 606, joint 608, or both joints 606, 608. Such a configuration would allow for the base 603 to be permanently or semi-permanently situated, with the lighting unit 602 being adjustable, depending upon the article disposed on the base.

Figure 7:
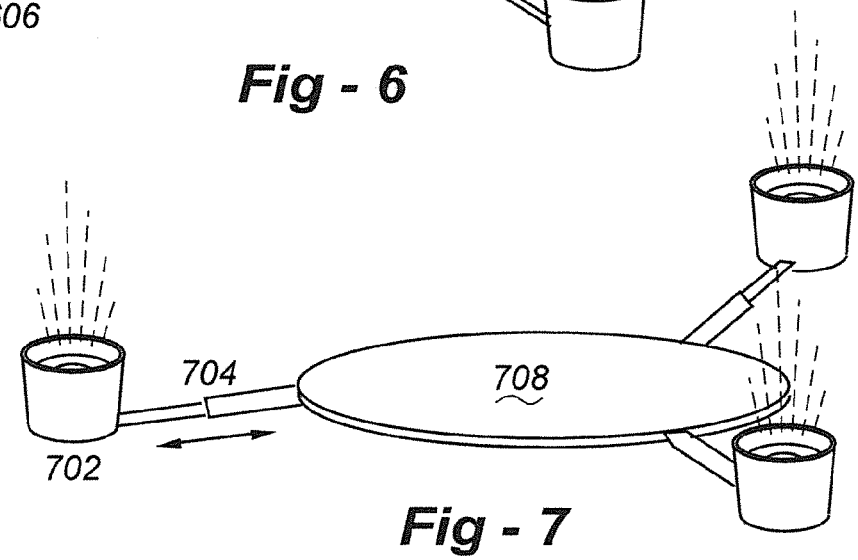
FIG. 7 is a drawing that shows lighting units on one or more telescoping arms.

FIG. 7 illustrates yet a further alternative, wherein base 708 is coupled to lighting units 702 through telescoping arm 704, allowing for distance adjustment from the center of the base. As with other embodiments, more and more of the swivel joints 606, 608 shown in FIG. 6 may be used with and without the telescoping arms.

Figure 8:
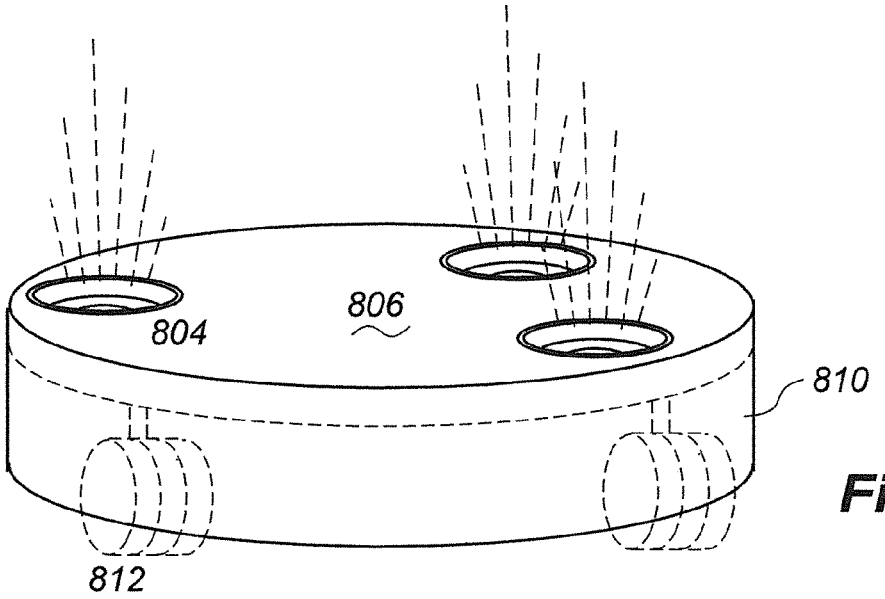
FIG. 8 is a drawing that shows lighting "cans" which are recessed relative to a platform surface, and a skirt to hide features such as casters.
Figure 9A:
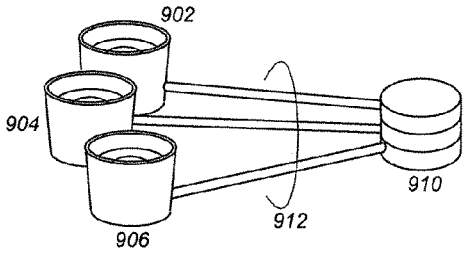
FIG. 9 illustrates one way in which the invention may be folded and unfolded for use.
Figure 9B:
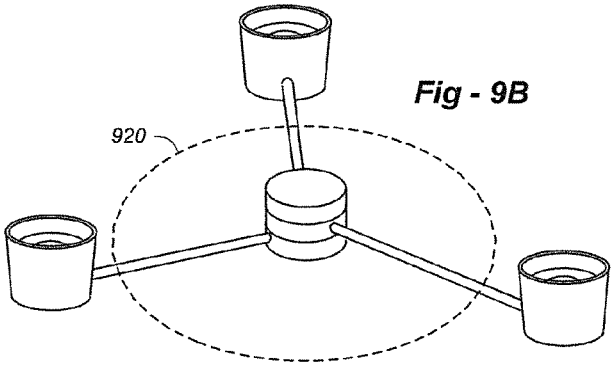
Figure 9C:
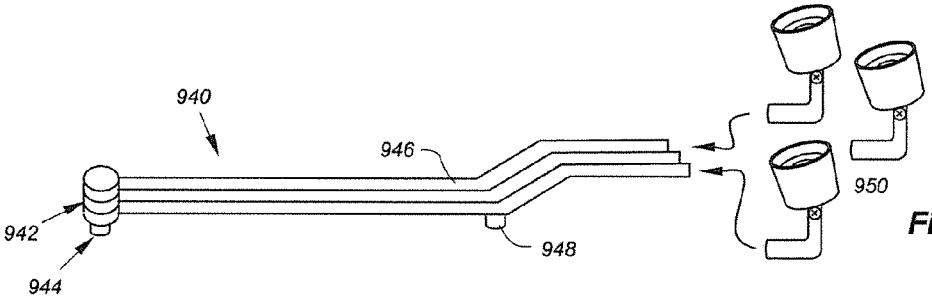
Figure 9D:
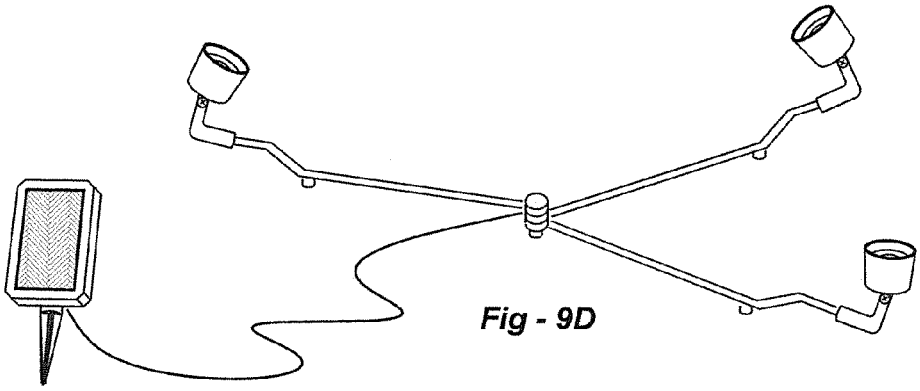

FIG. 8 illustrates a configuration of the invention wherein the lighting "cans" 804 are located below a platform surface 606 from which there extends a "skirt" 810. Such a configuration is not only aesthetically pleasing, but also allows features such as casters 812 to be hidden beneath the skirt 812. To fold up for shipping or storage, FIG. 9A shows a configuration wherein lighting units 902, 904, 906 are connected to a "hub" 910 through arms 912. As shown in FIG. 9B, the arms may be pivoted outwardly, creating a surface 920 upon which to rest a plant or a decorative article. FIG. 9C illustrates a slightly different configuration at 940 having a 'hub' 942 that rests on 944. In this case the arms 946 are bent upwardly, each with a bottom 'foot' 948 to provide for level structure as shown in FIG. 9-D. The arms 946 may or may not be telescoping, and the lamps 950 may slide on. Casters are optional. The frame may be fabricated from steel strips (i.e., ⅛"×¾-1" stock) and formed to create a folding trivet, using central hinge 942. The end user will push the light bracket over the tip of each leg for final assembly and then place the solar panel in a nearby, sunny area.

Figure 10A:
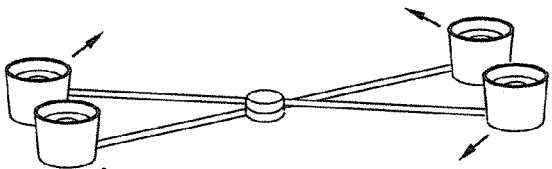
FIG. 10 illustrates yet a further folding/unfolding mechanism in accordance with the invention.
Figure 10B:
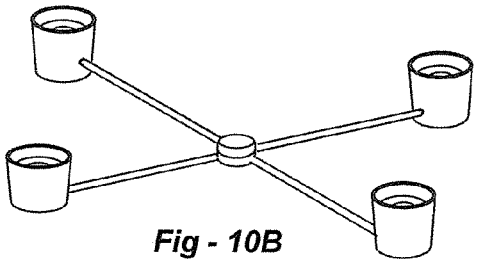

FIGS. 10A and 10B illustrate a different configuration wherein lighting units are disposed on two (or more) longer arms through a central hub, allowing the cans to be positioned toward and away from one another to create configurations such as that shown in 10B. Again, the unfolded support arms would create a base upon which to rest a potted plant or decorative article to be illuminated.

Figure 11:
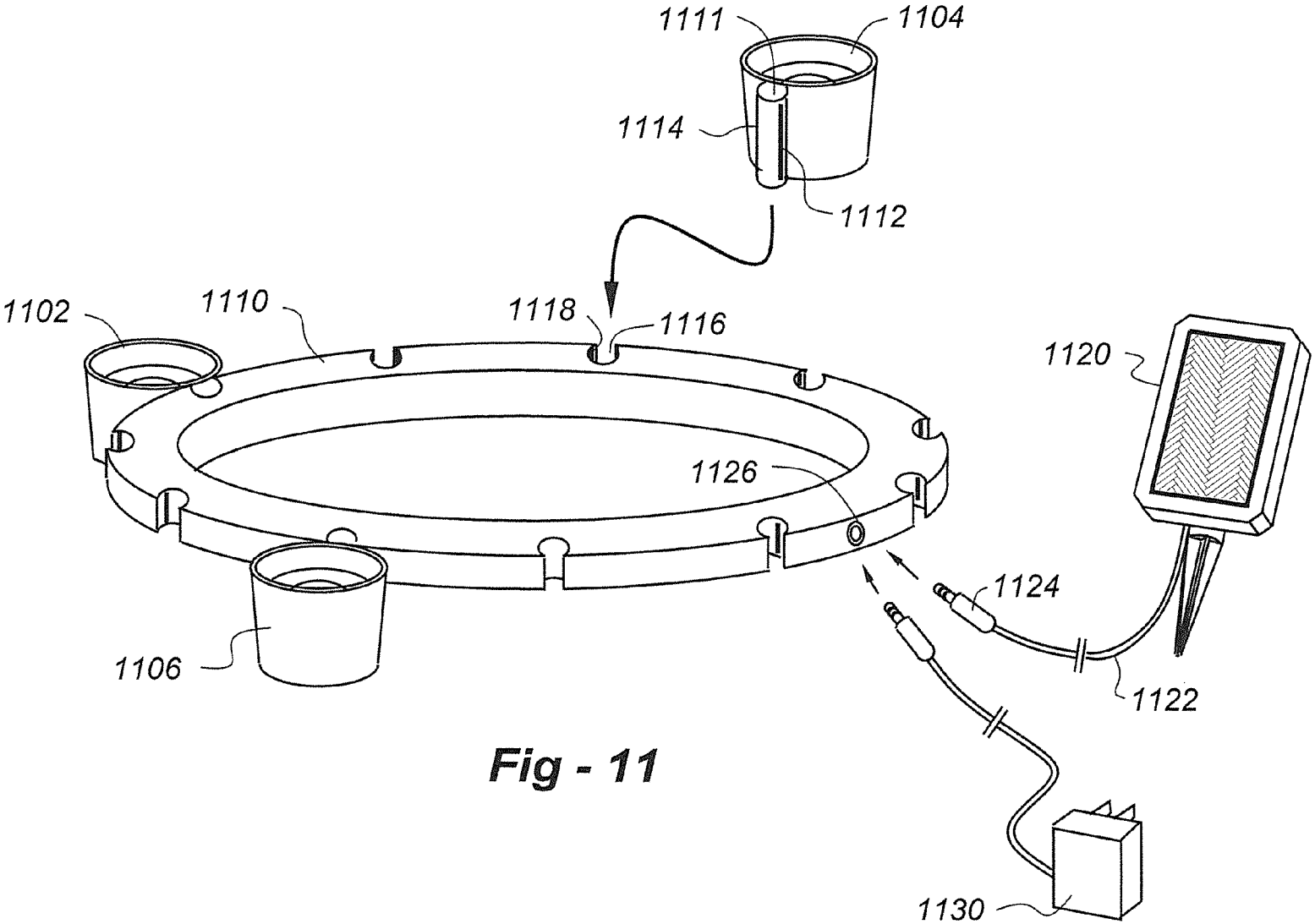
FIG. 11 depicts an embodiment of the invention whereby lighting units may be removable repositioned around the periphery of a base unit.

FIG. 11 depicts an embodiment of the invention whereby lighting units 1102, 1104, 1106 may be removable repositioned around the periphery of a base unit 1110. In this case each lighting unit has a structure such as a rib 1111 which is received by a corresponding receptacle. The rib, regardless of shape, has two conductive strips 1112, 1114 which make contact with strips 1116, 1118 in each receptacle. This configuration allows a user to place the lights where desired, and to avoid lighting surrounding objects or surfaces to be de-emphasized. FIG. 11 also shows the use of a solar power pack 1120 with a connector 1124 that mates with jack 1126 via cord 1122. This configuration, which may be used with any of the embodiment disclosed herein, allows a user to purchase and use either the solar unit or AC power adapter 1130 for indoor uses, for example. This versatility also allows the seller to offer the solar or AC units with illuminated gazing globes, fountains, path lights and other products that use electricity for whatever purpose.

I claim:

1. A system for illuminating an article, comprising:

a base defining a plane upon which to position the article, the base having a periphery;

a plurality of support arms, each support arm extending radially outwardly from the periphery of the base and terminating in a distal end, the length of each support arm being adjustable so as to vary the distance of each distal end from the periphery of the base in a plane parallel to the plane of the base;

a plurality of lighting units, each lighting unit being coupled to a respective one of the distal ends of the support arms;

each lighting unit being oriented upwardly so as to illuminate different sides of the article from below;

a solar panel for generating electricity from sunlight;

a battery charged by the solar panel;

a photodetector; and switching circuitry interconnecting the battery to the lighting units when ambient light falls to a predetermined level as detected by the photodetector.

2. The system of claim 1, wherein each lighting unit is pivotally coupled to a respective one of the distal ends of the support arms.

3. The system of claim 1, wherein the base includes a peripheral lip thereby forming a water-holding tray to support a potted plant.

4. The system of claim 1, wherein the base has an underside including a plurality of casters.

5. The system of claim 1, wherein the solar panel, battery and photodetector are disposed in a remote housing and interconnected to the lighting units through electrical wiring.

6. The system of claim 1, including a solar panel disposed on a portion of the base.

7. The system of claim 1, including a solar panel disposed on or in one or more of the lighting units.

8. The system of claim 1, wherein the lighting units are can-shaped, each with one or more light-emitting diodes.

9. The system of claim 1, wherein the lighting units are re-positionable around the periphery of the base.

10. The system of claim 1, wherein at least a portion of the solar panel functions as the photodetector.

11. The system of claim 1, wherein the base is circular, having a diameter in the range of 10 to 24 inches.

12. The system of claim 1, including three radially extendable support arms.

13. The system of claim 1, including three radially extendable support antis equally spaced around the periphery of the base.

* * * * *